United States Patent [19]

Sims, Jr.

[11] 4,034,177

[45] July 5, 1977

[54] PLUNGER-ACTUATED, LOST MOTION SWITCH WITH TACTILE FEEDBACK

[75] Inventor: Dewey M. Sims, Jr., Westland, Mich.

[73] Assignee: Burroughs Corporation, Detroit, Mich.

[22] Filed: Nov. 19, 1976

[21] Appl. No.: 743,240

[52] U.S. Cl. ..... 200/159 R; 200/16 C; 200/153 V; 200/154; 200/277; 339/5 P

[51] Int. Cl.[2] ..... H01H 13/52

[58] Field of Search ..... 200/16 R, 16 B, 16 C, 200/16 D, 153 V, 154, 159 R, 277; 339/5 P

[56] References Cited

UNITED STATES PATENTS

| | | | |
|---|---|---|---|
| 3,032,620 | 5/1962 | Siiberg | 200/277 X |
| 3,223,813 | 12/1965 | Lewandowsky | 200/159 R |
| 3,375,335 | 3/1968 | Schultz | 200/153 V |
| 3,586,810 | 6/1971 | Brown | 200/159 R X |
| 3,732,387 | 5/1972 | Berry | 200/159 R |
| 3,735,058 | 5/1973 | Berry | 200/16 R |
| 3,767,878 | 10/1973 | Sykora | 200/159 R |
| 3,823,992 | 7/1974 | Murata | 200/159 R |
| 3,883,704 | 5/1975 | Barney | 200/277 X |
| 3,895,203 | 7/1975 | Leworthy | 200/276 |
| 3,902,775 | 9/1975 | Speller | 200/277 X |
| 3,920,943 | 11/1975 | Lapointe | 200/159 R |
| 3,924,089 | 12/1975 | Abernethy | 200/159 R |
| 3,940,585 | 2/1976 | Schaad | 200/159 R |

*Primary Examiner*—Volodymyr Y. Mayewsky
*Attorney, Agent, or Firm*—Robert C. J. Tuttle; Carl Fissell, Jr.; Kevin R. Peterson

[57] ABSTRACT

A plunger actuated, electrical switch uses a lost motion mechanism to prevent the switch from making and breaking contact more than once for each plunger depression. The plunger drives a contact element from a rest position to a contact position where electrical communication between two terminals is established and remains established until the plunger has retreated a fixed amount through a range of lost motion, whereupon it re-engages the contact element and drives it toward the rest position, breaking electrical communication between the terminals.

9 Claims, 4 Drawing Figures

PLUNGER-ACTUATED, LOST MOTION SWITCH WITH TACTILE FEEDBACK

INTRODUCTION

This invention relates to mechanically actuated, electrical switches and more particularly to a plunger-actuated switch of the type suitable for inclusion in the keyboard of an information processing device.

BACKGROUND OF THE INVENTION

The growth of electronic data processing technology has engendered many data entry or encoding devices which enter or encode information by the actuation of keyboard switches. A typical embodiment of the keyboard switch includes a tactile-actuated plunger which causes contact between two electrical terminals when depressed by an operator.

A problem associated with this general type of switch is the double contact phenomenon which will cause the terminals to make and break contact two or more times during one plunger depression. This occurs when the depressive actuating force is applied erratically and sustained longer than required to make the initial contact. This is obviously an undesirable effect which must be taken into account when designing a keyboard switch. The solution of this problem through an inventive switch design that is simple, economical and easy to manufacture is a principal objective of the present invention.

BRIEF SUMMARY OF THE INVENTION

The present invention embodies a lost motion technique in a plunger-actuated switch to effectively minimize the phenomenon of double contact. In essence, when the switch actuating force is removed and the plunger is urged back toward its rest position, there is a short span of lost motion before the plunger engages a contact element and causes electrical communication between the switch terminals to be broken. During the period of lost motion, any small spurious or erratically applied force on the switch plunger is ineffective to move the contact element and break electrical communication. As a result the likelihood of double contact is greatly minimized.

A further feature of the present invention is the inclusion of threshold means to provide tactile feedback to the operator to inform him of the position of the contact element within the switch assembly. Basically, when the plunger is actuated by a depressive force, it engages the contact element and causes it to travel from a rest position to a contact position. In the path of travel between the two positions is provided a pair of interference ridges which represent a force threshold the contact element must pass over in order to move from the rest position to the contact position. The operator is given a feel for the position of the contact element despite the lost motion relation between the actuating plunger and the contact element.

Other features, modifications and advantages of the invention will be made apparent from the following detailed description of a specific embodiment which is to be taken in conjunction with the drawing wherein.

DETAILED DESCRIPTION OF A SPECIFIC EMBODIMENT

Figure 1:
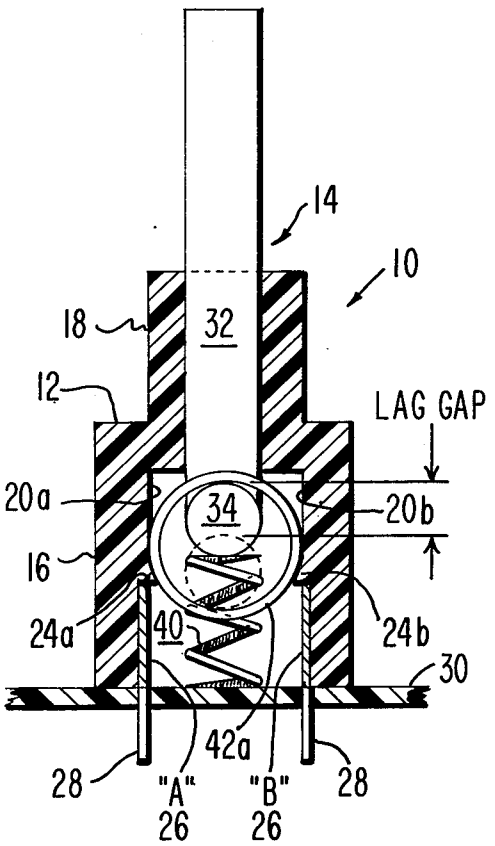
FIG. 1 is a cross sectional view of an electrical switch embodying the present invention.
Figure 2:
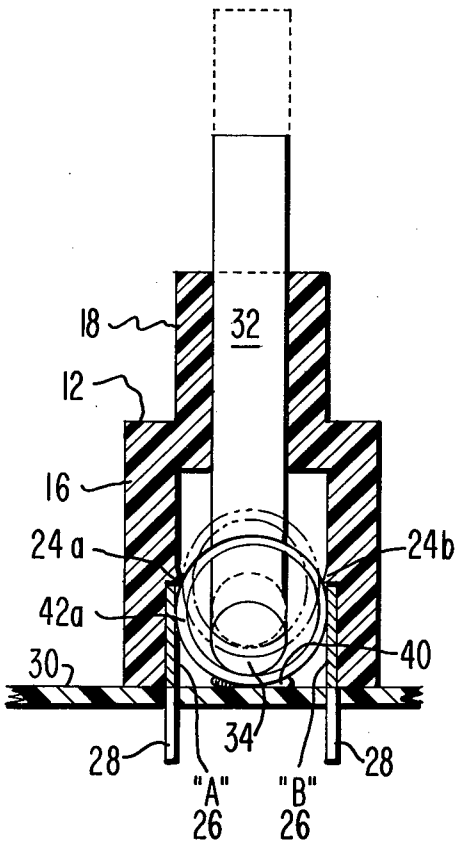
FIG. 2 is a cross sectional view of the same orientation as FIG. 1, but showing the switch advancing through various phases of the switching cycle.
Figure 3:
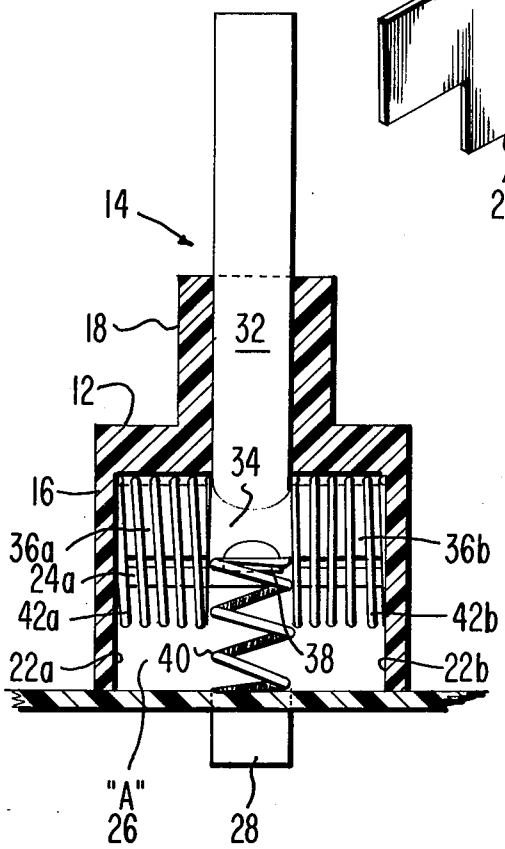
FIG. 3 is a cross sectional view of the switch taken at a view orthogonal to that of FIGS. 1 and 2.

An electrical switch formed in accordance with the present invention is shown in FIGS. 1 – 3. Especially in FIG. 1, the switch, generally at 10, is shown to comprise a housing 12 formed of a hollow integral body of molded dielectric material, such as Bakelite. The switch housing 12 supports the mounting of an actuating plunger assembly 14 which will be hereinafter described in greater detail.

Figure 4:
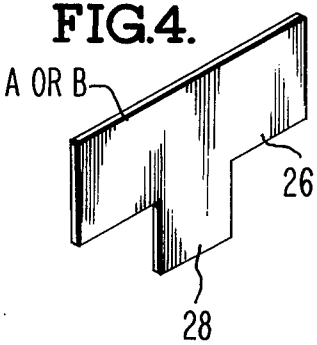
FIG. 4 is a perspective view of the terminal plates inlaid in the switch.

The switch housing 12 includes a hollow, lower base portion 16 and a upper collar or plunger guide 18. Within the hollow area of the lower base portion 16 are formed first and second pairs of opposed interior walls 20*a* and *b*, and 22*a* and *b;* the latter pair of walls being most clearly seen in FIG. 3. At a mediate position on the first pair of walls 20*a* and *b* are formed a pair of opposing interference ridges 24*a* and 24*b*. Each of the ridges 24 is formed in a cusp-like shape and projects inwardly. Functionally, they act as a force threshold for the passage of the plunger assembly 14 as will hereafter be described in detail. Beneath each of the interference ridges 24*a* and *b* are terminal plates A and B, formed of an electrically conductive material. Each of the plates A and B is effectively inlaid into the walls 20*a* and *b*. FIG. 4 represents the configuration of each terminal plate A and B and shows each plate to comprise a broad contact face 26 and a lower projecting tab 28. The lower tab 28 serves both to anchor the switch 10 to a base surface 30, such as a printed curcuit board, and also to provide an external contact for electrical leads attached to the switch.

The plunger assembly 14 is best illustrated in FIG. 3. The basic plunger comprises a shaft 32 disposed for reciprocal motion within the plunger guide 18 and an orthogonal actuator arm 34 formed integrally with the shaft 32. The integral plunger assembly may, like the housing 12, be formed of a molded dielectric material, such as Bakelite. The actuator arm 34 is disposed within the hollow base portion 16 so as to have its opposed lateral ends 36*a* and *b* adjacent respective walls 22*a* and *b*. Centrally disposed on the bottom side of the actuator arm 34 is a retaining stud 38. Stud 38 locks with one end of a compression spring 40 which has its other end supported against the base 30. The function of the compression spring 40 is to urge or bias the actuator arm 34 toward an uppermost rest position within the hollow base portion 16.

Symmetrically mounted on each of the actuator arms 36*a* and *b*. Each spring 42 is loaded under compression so that one end bears against the plunger shaft 32 and the opposite end bears against one of the respective walls 22*a* or 22*b*. As best seen in FIG. 1, the springs 42 are dimensioned to have an outside diameter that is substantially equal to the space between the opposed walls 20*a* and 20*b*. The inner diameter of the springs 42 is substantially greater than the thickness of the actuator arm 34 measured perpendicular to the base surface 30.

The operation of the switch 10 will next be described. First viewing FIG. 1, the switch 10 is seen in an unactuated or rest state. The compression spring 40 bears against the actuator arm 34 to urge it into its uppermost position. Accordingly, each of the springs 42*a* and *b* are maintained in the upper portion of the hollow base 16 and above the interference ridges 24*a* and *b*. When a depressive force is applied to the top of plunger shaft 32, the shaft travels downward against the compression spring 40 until it traverses a "lag gap" which is defined as the difference between the internal diameter of the springs 42 and the thickness of the actuator arm 34 measured perpendicular to base surface 30. During the time the plunger shaft 32 is traversing the lag gap, the operator, (if, for example, the switch is being used in a keyboard) feels only linear tactile feedback from the spring.

At the point when the actuator arm 34 has traversed the lag gap and begins to engage the springs 42, additional force is required to cause the springs to ride over the interference ridges 24*a* and *b*. As best seen in FIG. 2, this additional force causes slight elastic deformation in the radial dimension of the springs 42. Once the mid-point of the springs 42 pass over the ridges 24, the interference resistance is progressively relieved and the springs start to move against only the force of the spring 40 into the lower portion of the hollow base 16. This effectively gives the operator further tactile feedback to inform him that the applied force has overcome the interference threshold and electrical contact is about to be made. Upon the entry of the springs into the lower portion of the body 16, the springs return to their unstressed shape and contact the terminal plates A and B. With the springs 42*a* and *b* this lowermost in this lowermost position, there is an abundance of electrically conductive paths communicating terminals A and B.

When the depressive force which actuated the switch 10 is removed, the same lost motion effect which occurred at the beginning of actuation, i.e. when the actuator arm 34 moved downwardly through the lag gap, occurs again to minimize the possibility of making and breaking electrical contact more than once for each depression of the shaft 32. Upon removal of the depressive force, the biasing spring 40 acts upwardly on the actuator arm 34 and causes it to move through the lag gap in the manner hereinbefore described. It will be appreciated that for the time required for the actuator arm 34 to upwardly traverse the lag gap, the springs 42*a* and *b* remain in contact with terminals A and B, and will sustain contact despite any erratic or spurious depressive force which may occur as the actuator arm 34 is traversing the lag gap. When the actuator arm 34 engages the springs 42, the interference resistance of the ridges 24*a* and *b* is reintroduced to provide the same thereshold effect as was present when the shaft 32 was traveling downward. Once the springs 42 have passed over the ridges 24*a* and *b*, the compression spring 40 returns the shaft 32 to its uppermost rest position with minimal resistance. The effect of the interference ridges 24*a* and *b* is, again, to provide tactile feedback to the operator to tell him when the switching cycle has been effectively completed.

In summary, the present invention provides an electrical switch with tactile feedback to inform the operator of the condition of the switch at each stage of operation. Also, and of equal importance, is the provision of lost motion between the switch plunger and the contact element which it drives to minimize the occurrence of making and breaking contact more than once during each plunger depression.

Although the inventive concept has been shown in a specific embodiment, the invention is given to a wide range of embodiments without departing from the spirit or scope of the appended claims.

The embodiments of the invention in which an exclusive property or privilege is claimed are defined as follows:

1. An electrical switch of the class suitable for use in keyboards or the like comprising:

a dielectric switch housing defined by a hollow integral body having first and second pairs of opposed interior walls formed therein and further having an external aperture in communication with the hollow portion of said integral body;

a dielectric base surface supporting said switch housing;

a dielectric plunger defined by a shaft disposed for reciprocal motion within said external aperture and an actuator arm formed integrally with one end of said shaft and disposed within the hollow portion to have its opposed ends adjacent said first pair of opposed interior walls;

terminal means disposed on each of said second pair of opposed interior walls proximate said base surface;

biasing means for urging said plunger toward a rest position distal from said base surface;

electrically conductive annular means, dimensioned and disposed to freely encircle the ends of said actuator arm and to frictionally bear against said second pair of opposed interior walls, for defining a conductive path between said terminal means, whereby the conductive path is effected when said actuator arm is caused to travel against said biasing means from its rest position to a lowermost position proximate said terminal means and the conductive path continues effected until said actuator arm has traversed an initial distance from its lowermost position toward its rest position through a lost motion relation between said plunger and said annular means; and threshold means disposed on each of said second pair of opposed interior walls for interferring with the travel of said annular means to provide a force threshold for the passage of said actuator arm between its rest position and its lowermost position.

2. The electrical switch as defined in claim 1, wherein said threshold means are defined by inwardly projecting ridges formed on each of said second pair of opposed interior walls mediate the lowermost position and the rest position of the actuator arm.

3. The electrical switch as defined in claim 2, wherein said inwardly projecting ridges have a cusp-like shape.

4. The electrical switch as defined in claim 1, further including a collar formed about said external aperture and integrally with said hollow body for guiding the travel of said plunger shaft.

5. The electrical switch as defined in claim 1, wherein said biasing means is defined by a compression spring having one end supported against said base surface and another end supported against said plunger.

6. The electrical switch as defined in claim 1, wherein said terminal means are electrically conductive plates inlaid in said second pair of opposed walls in proximity to said base surface.

7. The electrical switch as defined in claim 1, wherein said annular means comprise first and second compression springs symmetrically mounted on said actuator arm, each spring having one end bearing against said plunger shaft and another end bearing against a respective wall of said first pair of opposed interior walls.

8. The electrical switch as defined in claim 1, wherein said base surface is a printed circuit board.

9. The electrical switch as defined in claim 1, wherein said annular means have an inside diameter substantially greater than the thickness of said actuator arm.

* * * * *

UNITED STATES PATENT OFFICE

CERTIFICATE OF CORRECTION

Patent No. 4,034,177 Dated July 5, 1977

Inventor(s) Dewey M. Sims, Jr.

It is certified that error appears in the above-identified patent and that said Letters Patent are hereby corrected as shown below:

Col. 2, line 55, after "36a and b" and before "Each" insert --are a pair of compression springs 42a and b--

Col. 3, line 31, delete "this lowermost".

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*